US007071673B2

(12) United States Patent
Menegoli et al.

(10) Patent No.: US 7,071,673 B2
(45) Date of Patent: Jul. 4, 2006

(54) PROCESS INSENSITIVE VOLTAGE REFERENCE

(75) Inventors: Paolo Menegoli, San Jose, CA (US); Carl K. Sawtell, San Jose, CA (US)

(73) Assignee: ACU Technology Semiconductor Inc., San Jose, CA (US)

( * ) Notice: Subject to any disclaimer, the term of this patent is extended or adjusted under 35 U.S.C. 154(b) by 73 days.

(21) Appl. No.: 10/911,467

(22) Filed: Aug. 4, 2004

(65) Prior Publication Data

US 2005/0046406 A1 Mar. 3, 2005

Related U.S. Application Data

(60) Provisional application No. 60/499,139, filed on Sep. 2, 2003.

(51) Int. Cl.
*G05F 3/16* (2006.01)

(52) U.S. Cl. ..... 323/315; 323/907

(58) Field of Classification Search ..... 327/513, 327/539, 540, 538, 103, 378; 323/313, 316, 323/314, 315
See application file for complete search history.

(56) References Cited

U.S. PATENT DOCUMENTS 3,617,859 A 11/1971 Dobkin
4,789,819 A * 12/1988 Nelson ..... 323/314
5,629,612 A * 5/1997 Schaffer ..... 323/313
6,535,020 B1 * 3/2003 Yin ..... 326/83
6,693,467 B1 * 2/2004 Marie ..... 327/103
6,828,847 B1 * 12/2004 Marinca ..... 327/513

OTHER PUBLICATIONS

R. Widlar, "New Developments in IC Voltage Regulators",IEEE Journal of Solid State Circuit, Feb. 1971,pp. 2-7,vol. 6.
A. Paul Brokaw, "A Simple Three Terminal IC Bandgap Reference", IEEE Journal of Solid State Circuit, Dec. 1974,vol. SC-9,No. 6.
R. Pease, "The Design of Bandgap Reference Circuits: Trials and Tribulations",IEEE 1990 Bipolar Circuit and Technology Meeting.

* cited by examiner

*Primary Examiner*—Rajnikant B. Patel

(57) ABSTRACT

Several methods to obtain process insensitive base-emitter forward voltage of a transistor are described. The main concept is to recognize that the transistor current gain is the parameter that affects this voltage the most with normal process variations. The use of transistor driven with known base current removes this error. In alternative, a method for compensating the base-emitter forward voltage variations is described. This is applicable to analog integrated circuits that utilize the base-emitter forward voltage of a transistor and in particular in applications that make use of either accurate voltage references, thermal sensing elements, solid state thermostats and very common thermal shutdown protection circuits.

8 Claims, 8 Drawing Sheets

PROCESS INSENSITIVE VOLTAGE REFERENCE

RELATED APPLICATION DATA

The present application claims priority from U.S. Provisional Patent Application No. 60/499,139 for PROCESS INSENSITIVE BASE-EMITTER FORWARD VOLTAGE filed on Sep. 2nd 2003.

BACKGROUND OF THE INVENTION

1. Field of the Invention

The present invention is in the field of electronic circuits. The present invention further relates to analog integrated circuits. The implementation is not limited to a specific technology, and applies to either the invention as an individual component or to inclusion of the present invention within larger systems which may be combined into a larger integrated circuit.

The invention also falls within the field of voltage reference circuits and also in the field of solid-state thermal sensors. These devices have been common in many electronic systems. More specifically, the invention falls into the class of all the analog integrated circuits that make use of the forward base-emitter voltage of a bipolar transistor.

2. Brief Description of Related Art

Integrated circuits commonly make use of accurate voltage references and thermal sensing elements that are based on the forward base-emitter voltage of an npn or pnp transistor. The most typical and known circuit is the bandgap voltage reference in its many topologies. Generally, it is desired that the reference voltage generated by the bandgap circuit be substantially invariant, both with temperature and with variations in process parameters.

The theory behind the function of the bandgap circuit is well known and was first introduced by Widlar ("New Developments in IC Voltage Regulators", R. Widlar, IEEE Journal of Solid State Circuit, vol. 6, pp. 2–7, February 1971 and U.S. Pat. No. 3,617,859) and then described in several publications including "A Simple Three-Terminal IC Bandgap Reference", A. Paul Brokaw, IEEE Journal of Solid State Circuits, vol. SC-9, No. 6, December 1974.

The main concept is to balance a PTAT (proportional to absolute temperature) term, generally generated by a Delta Vbe (ΔVbe), with a term that has a negative temperature coefficient, commonly derived from the Vbe (forward base-emitter voltage) of an npn or pnp. The resulting voltage reference is typically about 1.2V, silicon bandgap voltage. Similarly thermal sensors and solid-state thermostats make use of the known, predictable and relatively linear negative coefficient of the Vbe to generate voltages function of the temperature and/or to activate circuits only at pre-determined temperatures.

Conventional bandgap based voltage references and solid state thermostats do not offer a great accuracy, because the Vbe term is subject to variations with standard wafer manufacturing process parameters variability. It is widely recognized that many parameters contribute to the variability of the conventional bandgap voltage references, with the Vbe being by far the most important. Generally the PTAT term is much better controlled being mainly subject to matching errors (either currents, resistors or emitter areas matching).

The most widely utilized technique to achieve accuracy in integrated voltage references is to trim the output voltage by modifying the values of resistors in the circuit, in order to increase or decrease the PTAT term with respect to the Vbe term. The most conventional trimming techniques are either zener-zapping, metal fuses, poly fuses and EEPROM non-volatile memory. After the circuit is fabricated, the voltage reference is measured and the trimming operation is performed to adjust the reference.

As shown in FIG. 1, a typical trimming technique applied to a bandgap circuit 1, in the known Brokaw configuration, is aimed at modifying the value of the resistors R1 or R2 after the integrated circuit is fabricated. Although it is widely recognized that the main source of error in the voltage reference circuits is the Vbe variation of the transistor Q1, typically the Vbe is not directly corrected by trimming. Instead the PTAT term is corrected by trimming the values of the resistors R1 and R2 to compensate for the Vbe error.

However the trimming techniques are not desirable because they require large silicon area and longer test time to actually perform the trimming, contributing to the manufacturing costs of the device.

Accordingly, what is needed is a circuit to correct for the Vbe variations and to generate a process insensitive npn or pnp forward base-emitter voltage. This would allow the implementation of more accurate analog integrated circuits and in particular more accurate bandgap voltage references and thermal sensors without the need of very complex and expensive trimming techniques or with a reduced set of trimming elements.

SUMMARY OF THE INVENTION

The present invention provides an npn or pnp forward base-emitter voltage which is insensitive to process variations. This invention allows many precise analog integrated circuits that are based on this base-emitter voltage to be implemented directly without the use of analog trimming or with a reduced set of analog trimming. This invention reduces the cost of the devices because the trimming circuits occupy large silicon areas, and because the trimming operation adds time and cost to manufacturing.

The invention stems from the realization that several parameters affect the value of the base-emitter forward voltage in an npn. The most known formula for the Vbe is:

$$Vbe = \eta Vt * \ln\left(\frac{Ic}{Is}\right)$$

From this formula it is evident that what affects the Vbe is the saturation current Is. The parameter η is generally relatively stable for conventional semiconductor processes. The saturation current, on its turn, is affected by parameters like the minority carrier concentration, the minority carrier life-time, the donor atom concentration and others.

In more practical terms, though, the Vbe is generally mostly affected by three parameters:

a) emitter area lithographic deviations.

b) collector current variations c) base width variations.

The emitter area may change from wafers lot to wafers lot due to lithographic variations if its physical dimensions are small in comparison to the minimum lithographic process dimensions. It is therefore preferable to use non-minimum emitter areas when the accuracy is an important factor. The emitter area has an effect on the current density in the transistor and therefore, any variation in the current density is linked to Vbe variations. A change in the area of 10% has an effect of only 2.5 mV of variation of the Vbe.

Typically the collector current is set by the bias source which forces a controlled voltage across an integrated resistor. The integrated resistors are affected by normal sheet resistivity variations that could be in the order of +/−15%. This has an effect of only 3.5 mV of variation of the Vbe. Also in this case the choice of the resistor with the smallest manufacturing spread is important to minimize the variations of the Vbe with process.

The base width variations are the major source of Vbe variation because the base width affects directly the transistor current gain also known as beta (β=Ic/Ib). A small change in base width may result in a major change in the transistor beta. Typically we can estimate that the beta may vary at least by a 2:1 ratio resulting in a Vbe variation of 18 mV. A variation of 18 mV for a bandgap reference voltage represents a noticeable variation of about 1.5%.

This simple observation, confirmed by experimental data and also by a publication by Robert Pease "The Design of Bandgap Reference Circuits: Trials and Tribulations", IEEE 1990 Bipolar Circuits and Technology Meeting, shows that for an increase in beta there is a corresponding decrease in Vbe and vice versa. This inter-dependence between beta and Vbe with process variations suggests that the relation is logarithmic.

Therefore the more correct formula for the Vbe could be expressed as:

$$Vbe = \eta Vt * \ln\left(\frac{Ic}{\beta * Isx}\right) = \eta Vt * \ln\left(\frac{Ib}{Isx}\right)$$

where Isx is the saturation current of the base-emitter junction. This formula reflects the general mathematical relation between a forward biased junction voltage and its current, where in this case, the diode is the base-emitter junction.

Practically this formula can be interpreted by saying that the Vbe of an npn is a function of its base current and its base-emitter junction saturation current. This formula also suggests that in order to keep the Vbe of a transistor constant, its base current should be maintained constant. This is not what is generally done for established circuits like the voltage reference circuits where the collector current is controlled and not the base current. The general practice, in use for the last 40 years, has been to make circuits that are process-insensitive, by designing them in such a way that they are independent of the beta of the transistors.

The present invention provides a method for generating a much more accurate Vbe than in conventional circuits, either by driving the transistor with constant base current or by compensating for the Vbe variation taking into account that if the Vbe is varying, its current gain is varying as well and vice versa. This compensation could be achieved in various ways.

If an npn transistor is driven with constant base current, then the beta variations become collector current variations, but its Vbe will remain substantially constant with varying beta. Of course, in practical circuit implementations, the base current cannot be constant and it is generally generated as a voltage (example PTAT) divided by a resistor. This implies that the sheet resistivity variations still affect the transistor Vbe exactly in the same manner that it does for the case described above when the base current is derived by the collector current and its beta.

In a conventional Widlar or Brokaw bandgap circuit cell, if the beta of the npn varies with process, its Vbe changes as well and the reference voltage with it. Typically the transistors collector currents are PTAT and the base current of the transistor generating the needed Vbe is determined by its collector current and by its beta.

If we provide for arbitrarily good photolithographic matching, we can neglect the error due to the Delta Vbe term. The main errors to a bandgap voltage reference are the errors due to the resistors variations affecting the Vbe (around 3.5 mV corresponding to +/−0.3%) and the error due to the beta variations (around 18 mV corresponding to +/−1.5%). This Vbe error due to the beta variations with process is the error addressed by this invention.

In a bandgap circuit, where its Vbe is given by a transistor whose base current is fixed or, more practically, by a PTAT voltage divide by a resistor R, its collector current is given by the product of its beta and its base current. If the beta of the transistor varies as result of the base width process spread, then its Vbe will not be affected by the change because its base current is not varying. Its Vbe will be only affected by the variations of its base current which is affected by the integrated resistor variations. This should account for a very small variation with process.

In alternative, in a bandgap circuit, where the error due to the beta variations with process is compensated by an equivalent PTAT voltage function of the beta of a transistor of the same type of the one used in the bandgap circuit, the resulting voltage reference can be made much more insensitive to the process variation of beta. This method ultimately implements an adaptive means for correcting for the Vbe process variations in a similar way to the trimming techniques with the advantage that no trimming is required.

It is also observed that in a bandgap circuit that implements this methods to generate a process insensitive Vbe, the value of the bandgap voltage reference that exhibits a temperature coefficient very close to zero, is lower than in conventional bandgap circuits and much closer to the theoretical value of the bandgap of silicon (1.21V).

Another source of error in bandgap voltage references is the voltage shift that occurs during the packaging phase of the finished device. This is due to the different profile of the minority carriers in the transistor induced during the package fabrication phase by mechanical stress. This causes a change in beta and Vbe. Preliminary data from early prototypes of corrected bandgap voltage references show that also the voltage shift is corrected by this invention.

Very similarly a common circuit to detect and sense the junction temperature of the integrated circuit and to eventually disable or enable a second circuit at a pre-determined temperature, makes use of the base-emitter forward voltage Vbe. In conventional circuits these circuits operate comparing the PTAT voltage or the Vbe voltage with a bandgap voltage reference. In some cases the PTAT voltage is directly compared with the Vbe voltage.

In all these cases the temperature dependent voltages are designed to be equal at the desired temperature, and a comparator will generate a signal active only above or below the pre-determined temperature. In all these cases, the accuracy of the Vbe term is the most important parameter to determine the total temperature precision of the implemented function and this invention allows more accurate solid-state thermal sensors, thermostats and thermal shutdown circuits.

BRIEF DESCRIPTION OF THE DRAWINGS

Further details of the present invention are explained with the help of the attached drawings in which.

DETAILED DESCRIPTION OF SPECIFIC EMBODIMENTS

A. FIG. 2

Figure 2:
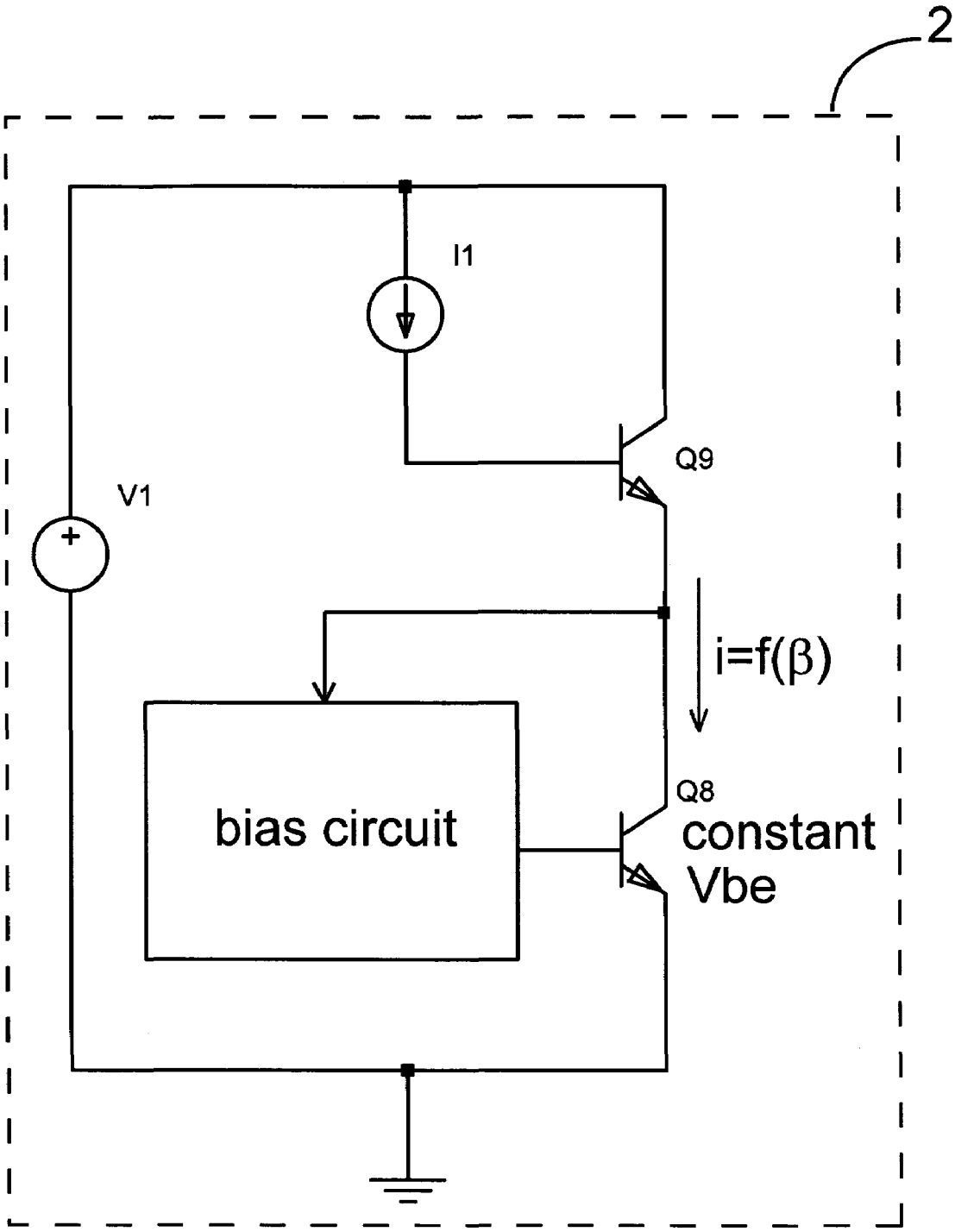
FIG. 2 is a general block diagram showing a first method to force the main transistor to be driven with a defined and known base current in accordance to the present invention.

A general embodiment, representing a fist method for generating a process insensitive Vbe circuit, is shown in the diagram 2 of FIG. 2. As depicted in the diagram, the npn transistor Q8 is biased in such a way that its collector current is known and always a function of the current gain (β) of a similar npn transistor Q9 whose base current I1 is known and relatively immune to large process variations. The transistor Q8 represents the transistor being part of the bandgap reference circuit whose Vbe should be kept constant.

It is assumed and commonly accepted that the beta of the npn device Q9 be always tracking the beta of the bandgap reference npn transistor Q8 on the same integrated circuit. Therefore it is recognized that, having the two transistors the same collector current, their base currents will be substantially equal. It is also assumed that the two transistors Q8 and Q9 be biased by the rest of the circuit, most commonly by a feedback circuit, in such a way that they could have substantially equal collector current.

If I1, the base current of Q9, is known and relatively insensitive to process variations, the base current of Q8 is also known and relatively insensitive, realizing in such a way the main objective of this invention, because the Vbe of the npn transistor Q8 is then independent from its beta and much more immune to the process variations. A minor limitation of this implementation is that the collector current value is more undetermined and the total supply current is subject to process variations.

B. FIG. 3

Figure 3:
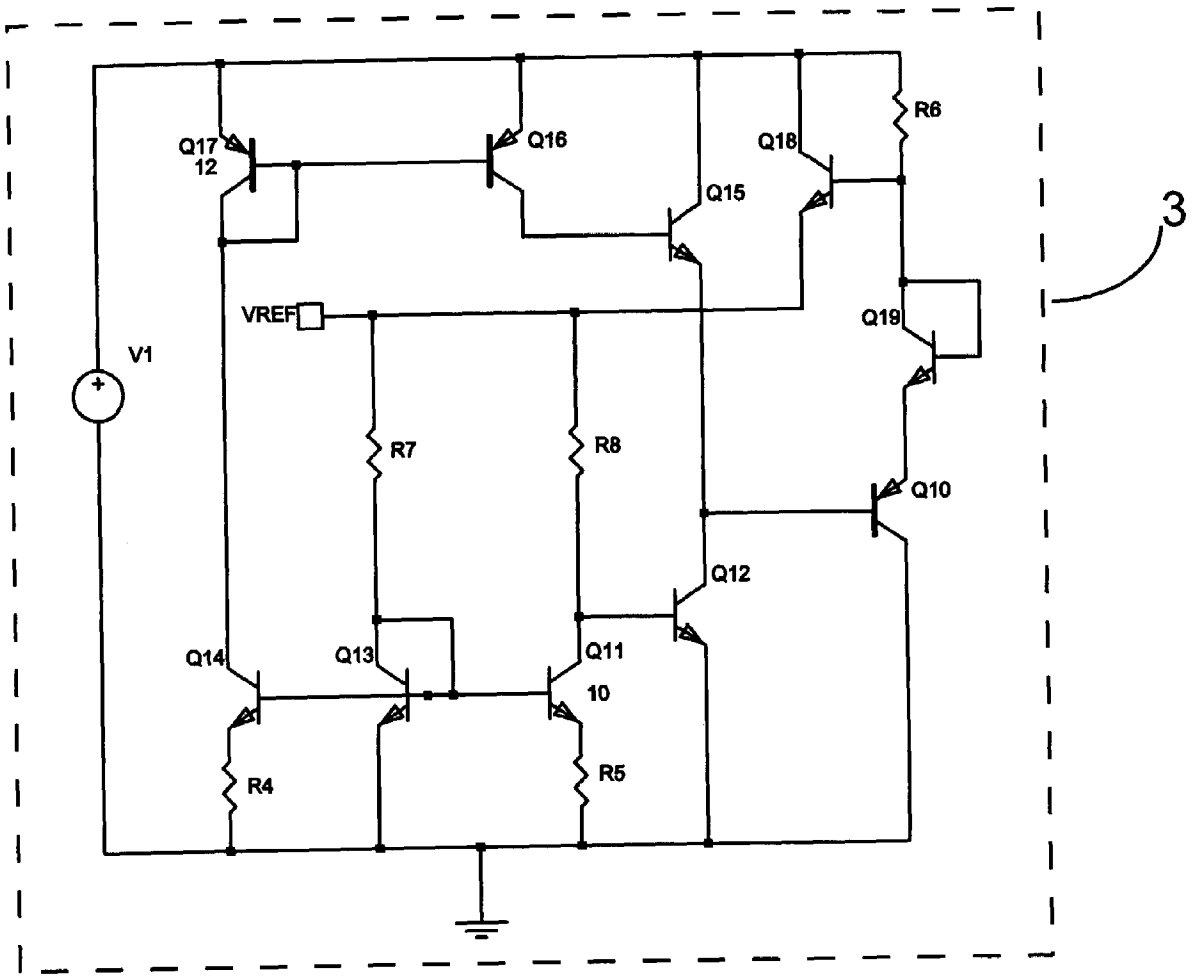
FIG. 3 is a circuit diagram showing a more detailed implementation of the first method applied to the bandgap reference circuit in Widlar configuration, in accordance to the present invention.

A preferred embodiment 3 of FIG. 3 implements the first method described in the diagram 2 of FIG. 2 applied to a conventional bandgap voltage reference circuit. In the preferred embodiment of the present invention as shown in FIG. 3, a conventional bandgap voltage reference in Widlar configuration has been modified to generate a more process insensitive voltage reference 3. The transistors Q16 and Q17 form a current mirror so that the current flowing into the base of transistor Q15 is equivalent to a portion of the current flowing into the collector of transistor Q14.

The current in the collector of the transistor Q14 is PTAT and given by $$Ic(Q14) = \frac{Vbe(Q13) - Vbe(Q14)}{R4} = \frac{\Delta Vbe}{R4}$$

The VREF node voltage is given by:

$$Vref = Vbe(Q12) + (Vbe(Q13) - Vbe(Q11)) * \left(\frac{R8}{R5}\right).$$

The main difference between this implementation and the traditional Widlar bandgap circuit is that the current in the transistor Q12 is given by β times the forced current in the base of the transistor Q15.

The Vbe of the transistor Q12 is now given by:

$$Vbe(Q12) = \eta Vt * \ln\left(\frac{Ic}{\beta * Isx}\right) = \eta Vt * \ln\left(\frac{\beta * \frac{\Delta Vbe}{R4}}{\beta * Isx}\right) = \eta Vt * \ln\left(\frac{\frac{\Delta Vbe}{R4}}{Isx}\right)$$

From which it can be noted that the dependence from the beta of the transistor is no longer present. This is due to the fact that if the beta of the transistor Q12 varies with process, then the same variation is assumed to affect also the transistor Q15. This circuit implementation guarantees that the base current of Q12 is the same as the base current of the transistor Q15 and ultimately that the Vbe of the transistor Q12 is much more immune to the process variations. The transistors Q12 and Q15 are analogous to the transistors Q8 and Q9 of FIG. 2.

C. FIG. 4

Figure 4:
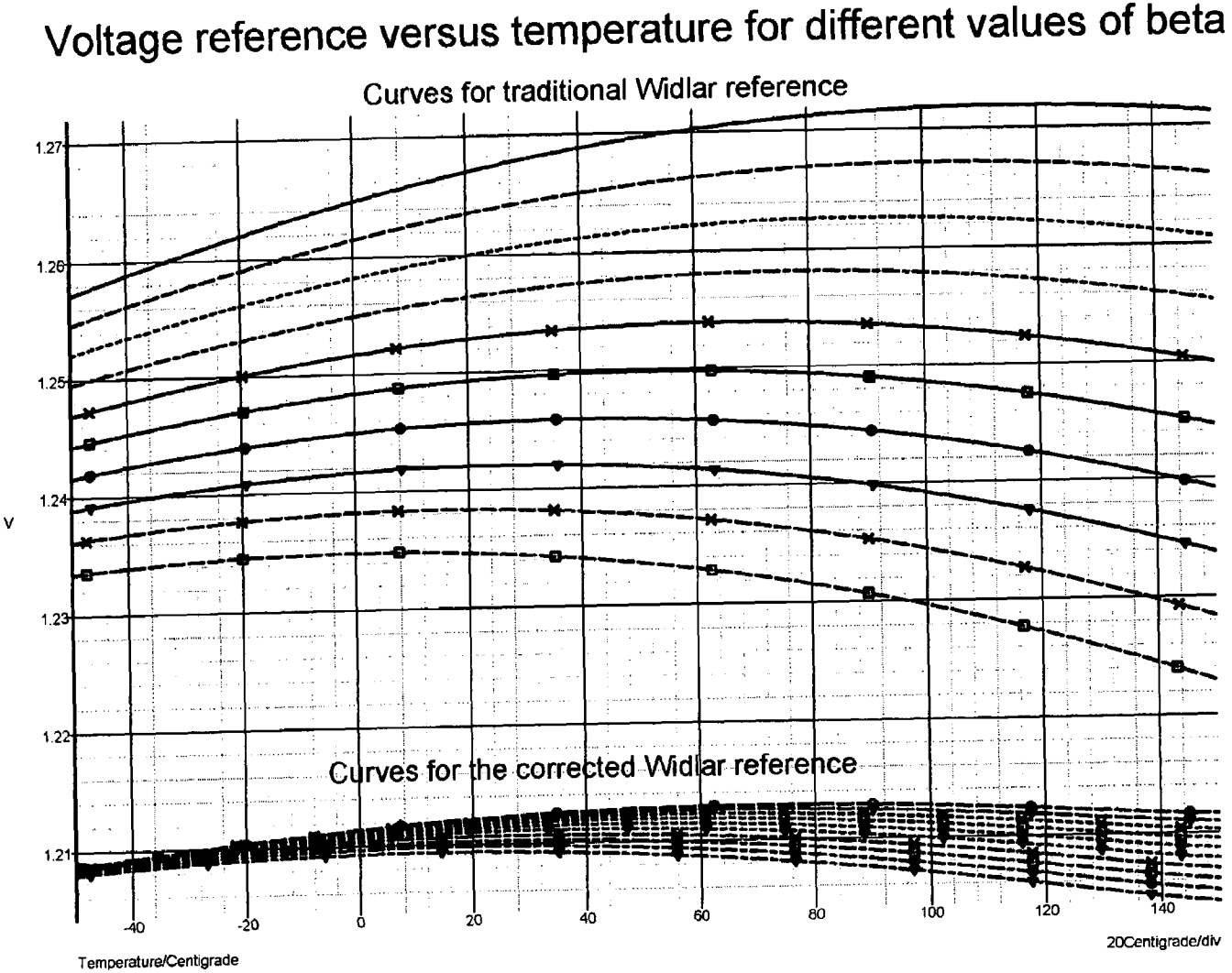
FIG. 4 is a plot of simulated results of the voltage reference versus temperature for different values of beta for the traditional voltage reference in the Widlar configuration versus the corrected bangap reference of FIG. 3.

FIG. 4 shows simulated results of the voltage reference versus temperature for different values of beta using the circuit simulator SPICE. SPICE models for conventional simulators do not include the relation between beta and the Vbe of the bipolar components. Special models have been generated to include this relation. The upper portion of the graph, shows a family of curves related to a state of the art conventional Widlar bandgap voltage reference. The lower portion is depicting the family of curves related to the corrected bandgap circuit 3 of FIG. 3. In both graphs the bandgap reference is swept over temperature at 10 different values of npn beta representing process variations.

For both families of curves the maximum beta variations is assumed to be 2 to 1. From the graph it can be noted that the family of curves for the conventional bandgap voltage reference spreads its values by nearly 40 mV with the beta variations. The family of curves for the beta corrected bandgap voltage reference 3 spreads its values by only a few mV with a slight dependence on temperature.

Furthermore it can be noted that the absolute value of the bandgap voltage reference for the beta corrected case is lower and closer to the theoretical value of silicon bandgap (1.21V). It can be also observed that the variations with beta of the corrected bandgap reference 3 are due to second order effects. With reference to the circuit 3 of FIG. 3, the collector current of Q12 is PTAT and not constant, and the collector emitter voltages of the transistors Q12 and Q15 are not equal and their dependence on beta vary, even if modestly, with temperature.

D. FIG. 5

Figure 5:
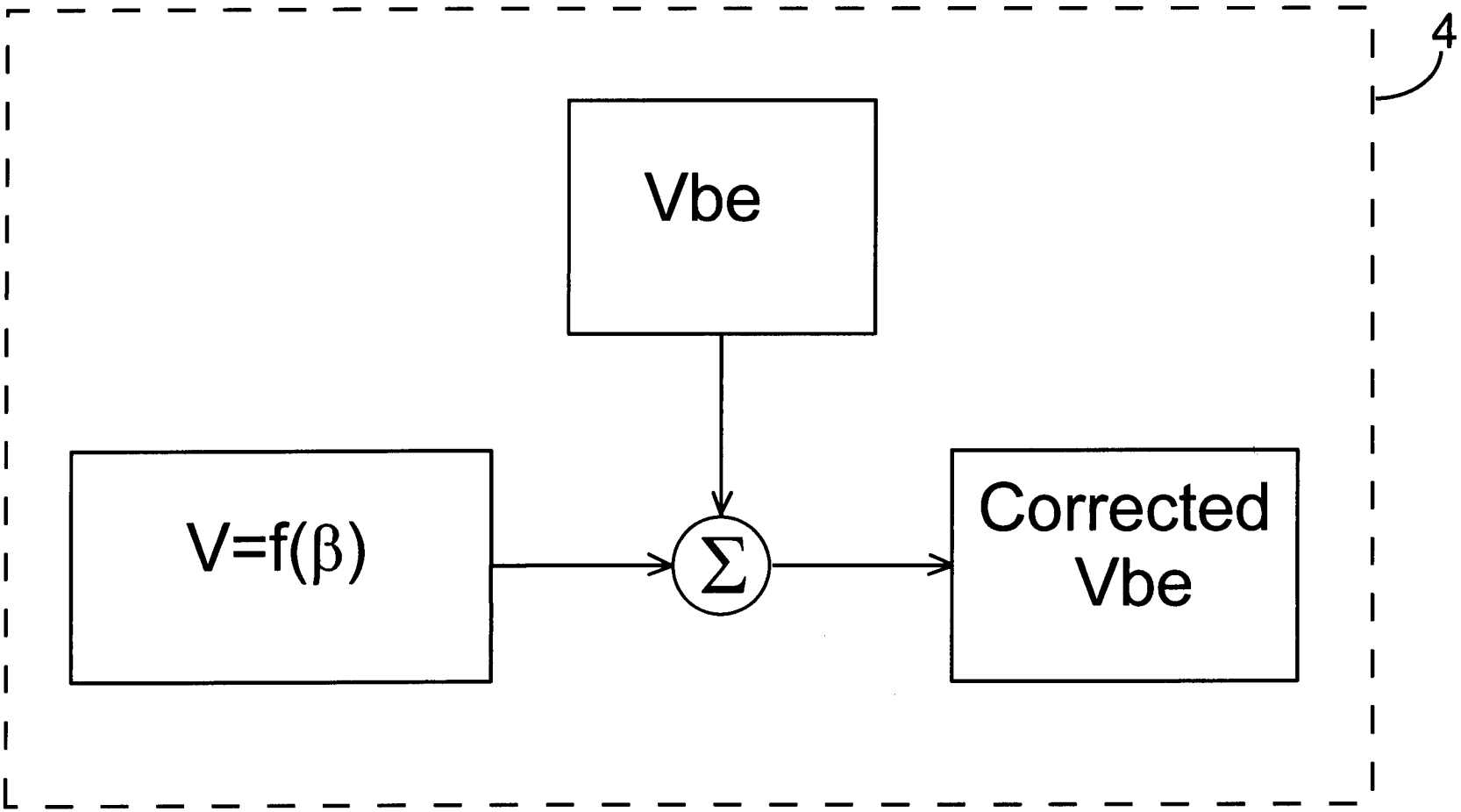
FIG. 5 is a general block diagram showing a second method to compensate for the error of the Vbe in accordance to the present invention.

In a further general embodiment of FIG. 5 a second method of compensating for the Vbe variations is described in block diagram 4. In accordance with this second method of the invention, a voltage is generated as a function of the beta of a transistor. This voltage is summed to the Vbe voltage of the transistor in the reference voltage.

The current gain (beta) and Vbe are inversely related. If the Vbe is smaller due to high beta, then an additional voltage, typically in the form of a PTAT voltage, is added to the reference voltage in order to compensate for the Vbe variation. As described in the diagram 4 of FIG. 5, the final result is to obtain a corrected Vbe more accurate and immune to the process variations.

E. FIG. 6

Figure 6:
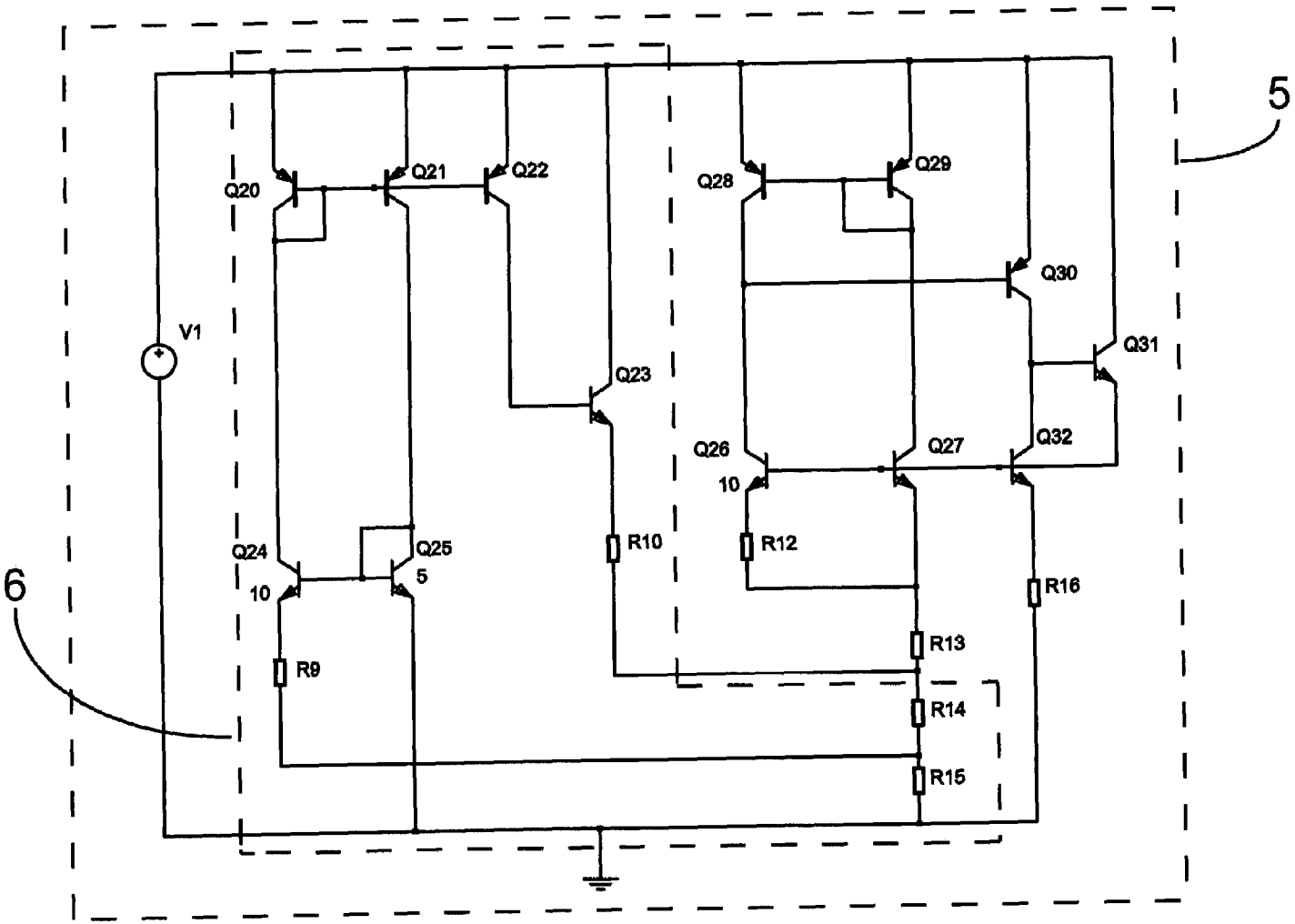
FIG. 6 is a circuit diagram showing a more detailed implementation of the second method applied to the bandgap reference circuit in Brokaw configuration, in accordance to the present invention.

A further embodiment 5 of FIG. 6 implements the second method described in the block diagram 4 of FIG. 5 applied to a conventional bandgap voltage reference circuit. In the embodiment of the present invention as shown in the circuit 5 of FIG. 6, a conventional bandgap voltage reference in a Brokaw configuration has been modified to generate a more process insensitive voltage reference 5. The difference between the more conventional Brokaw bandgap cell and this circuit implementation is shown in the section 6 of the circuit 5 and it includes the addition of the transistors Q20, Q21, Q22, Q23, Q24, Q25 and of the resistors R9, R10, R14 and R15.

The transistors Q24 and Q25, in addition to the resistors R9 and R15, generate a PTAT current that gets fed to the base of the transistor Q23. The transistor Q23 collector current is generating a voltage drop on resistors R14 and R15. The voltage drop on resistors R14 and R15 compensates for the process related Vbe variations of the transistor Q27. The beta variations of transistor Q27 are compensated by the beta variations of transistor Q23.

To explain the operation of this circuit let us assume that the beta of all NPN transistors, including Q27, decreases due to a process variation. In that case the value of the traditional bandgap voltage reference in Brokaw configuration would increase due to the increase of the Vbe of transistor Q27. But this increase is compensated by the reduced voltage drop on resistors R14 and R15 generated by the collector current of Q23, since its beta is assumed to decrease as for transistor Q27.

This second method can be utilized as a general correction of bandgap voltage references, but it does not implement an exact correction as the case of the circuit 3 of FIG. 3. In fact the temperature coefficient of the voltage reference is also a function of the beta of the npn transistor. A first order temperature curvature correction can be obtained, but at extreme values of current gain, the temperature coefficient of the voltage reference is deviating from zero, due to the dependence of beta with temperature.

F. FIG. 7

Figure 1:
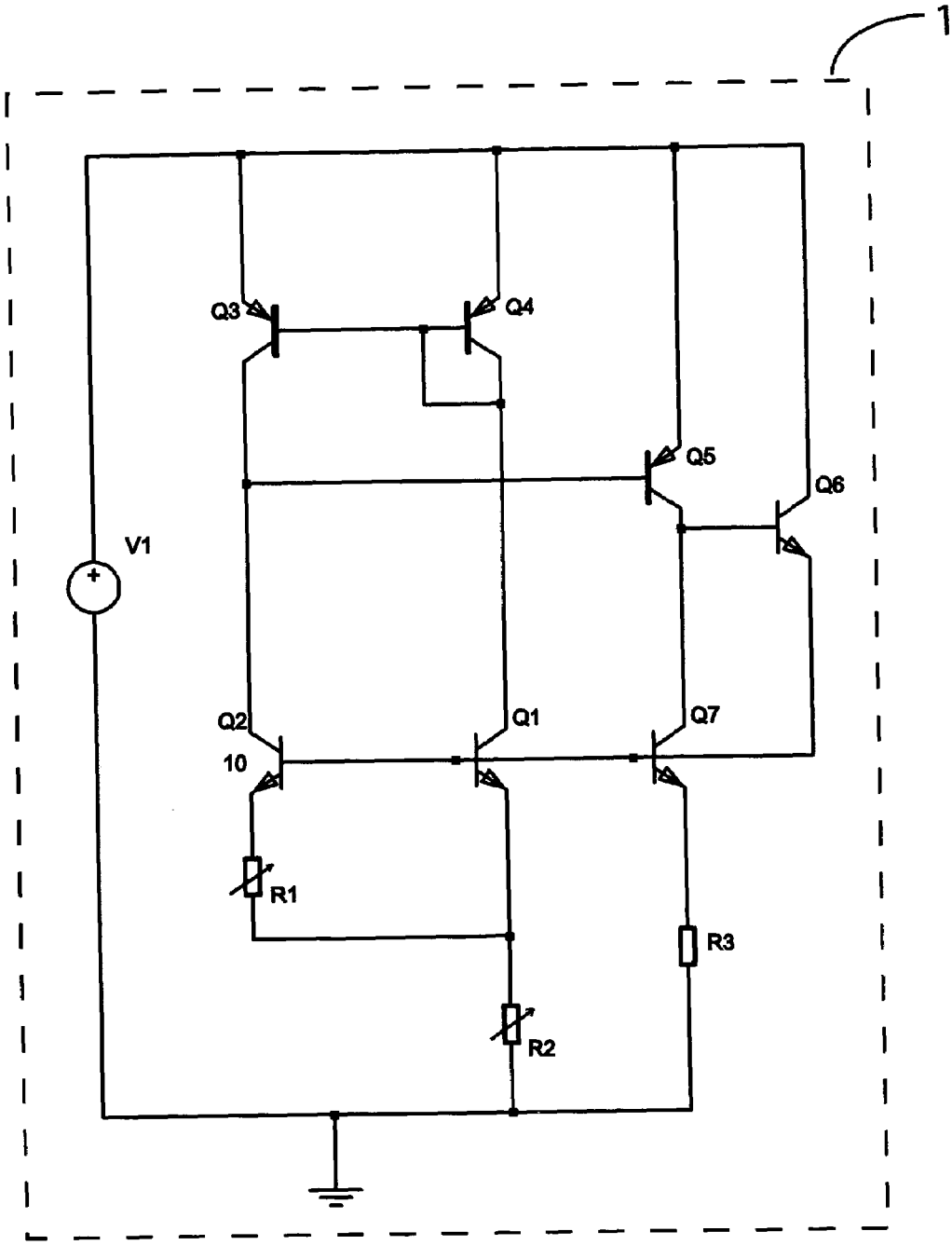
FIG.1 PRIOR ART
FIG. 1 is a typical bandgap reference circuit in the Brokaw configuration showing the prior art which makes use of trimming techniques to achieve higher accuracy.
Figure 7:
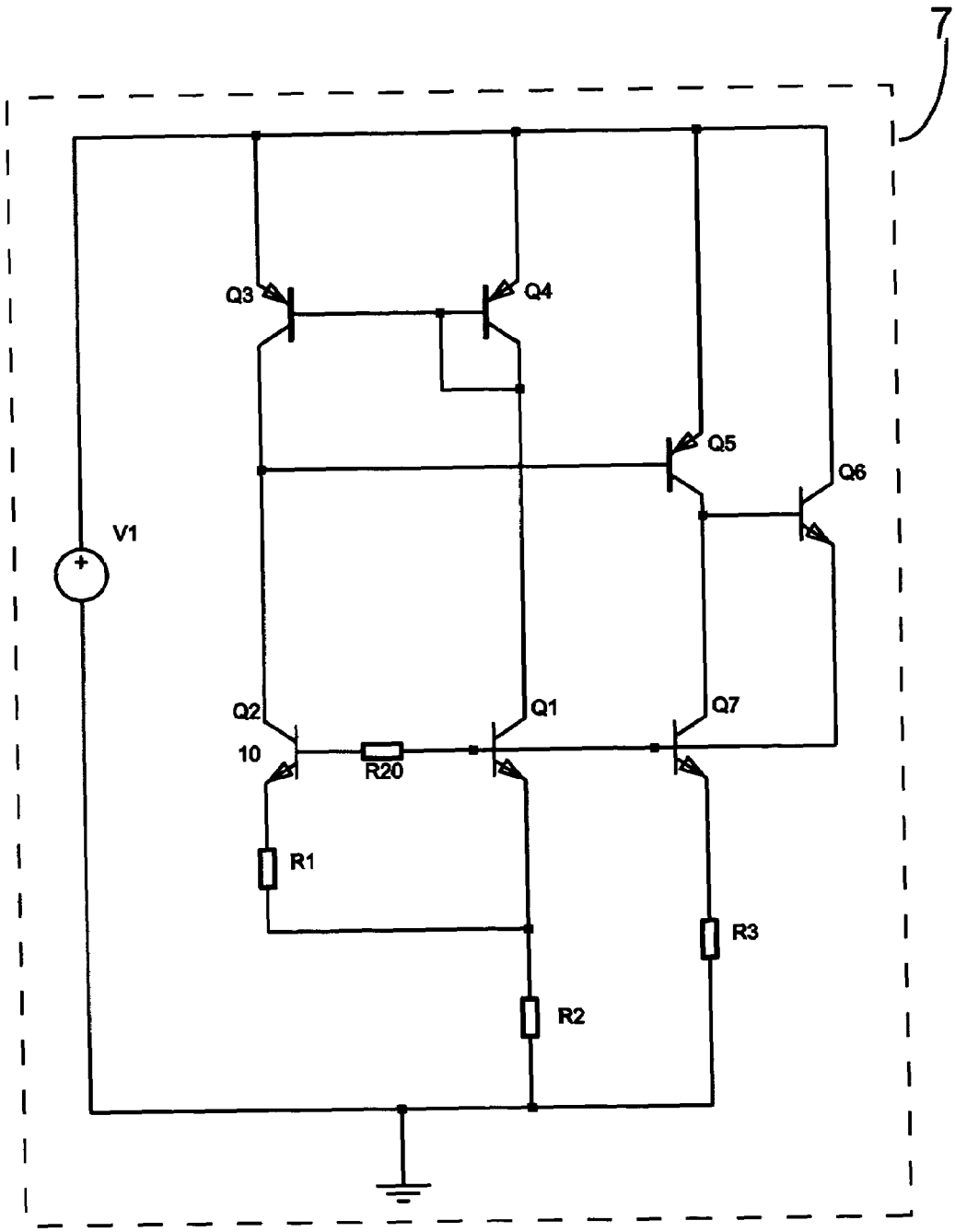
FIG. 7 is a circuit diagram showing a further detailed implementation of the second method applied to the bandgap reference circuit in Brokaw configuration, in accordance to the present invention.

A further embodiment 7 of FIG. 7 also implements the second method described in the diagram 4 of FIG. 5 applied to a conventional bandgap voltage reference circuit. In the embodiment of the present invention as shown in FIG. 7, a conventional bandgap voltage reference in a Brokaw configuration has been modified to generate a more process insensitive voltage reference 7. The difference between the more conventional Brokaw bandgap cell 1 of FIG. 1 and this circuit implementation is the addition of the resistor R20.

Assuming that the beta of transistor Q1 decreases with a process variation, the value of the traditional bandgap voltage reference in Brokaw configuration would increase due to the increase of the Vbe of transistors Q1 and Q2. But this is compensated by the reduced PTAT term. As the Vbe of transistors Q1 and Q2 increases, their beta is reduced adding a larger voltage drop on the resistor R20. This increased voltage drop on resistor R20 reduces of the same amount the available PTAT term ($\Delta$Vbe).

This second method of compensating for the process variations of Vbe is equivalent to the operation of the trimming techniques, in fact the trimming techniques compensate the excess of Vbe with a reduction of the PTAT term and vice versa. The main difference between the trimming techniques and this embodiment of the present invention is that the circuit implementation according to this invention is adaptive and does not require any action after the fabrication of the integrated circuit.

Although the invention is illustrated and described herein as embodied in a specific transistor configuration, it is nevertheless not intended to be limited to the details shown, since various modification and structural changes may be made therein without departing from the spirit of the invention and within the scope and range of equivalent of the claims.

G. FIG. 8

Figure 8:
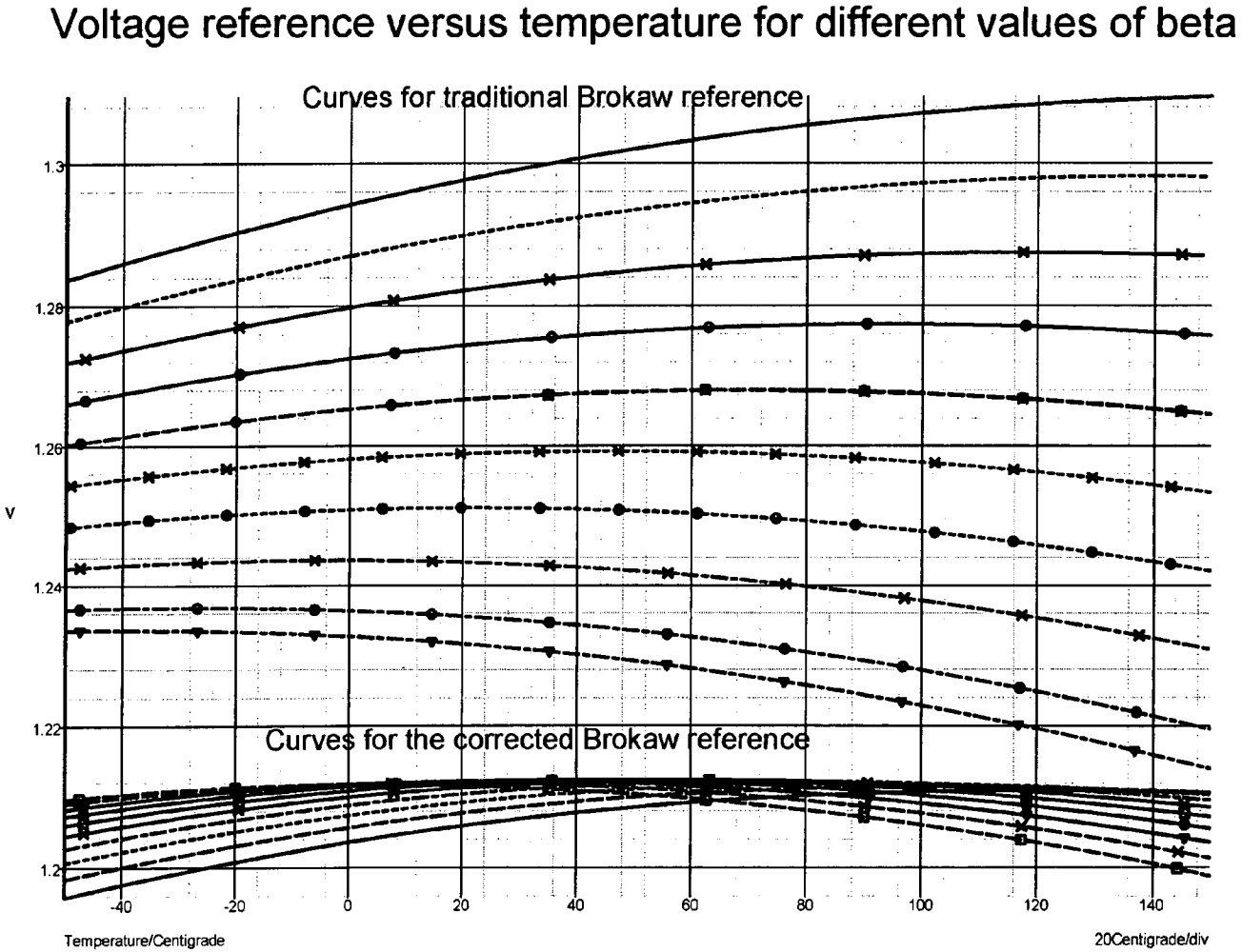
FIG. 8 is a plot of simulated results of the voltage reference versus temperature for different values of beta for the traditional voltage reference in the Brokaw configuration and for the corrected bangap reference of FIG. 6.

FIG. 8 shows simulated results of the voltage reference versus temperature for different values of beta using the circuit simulator SPICE. As for the case of FIG. 4, special SPICE models have been generated to include the relation between beta and Vbe of the bipolar components. The upper portion of the graph, shows a family of curves related to a state of the art conventional Brokaw bandgap voltage reference 1. The lower portion is depicting the family of curves related to the corrected bandgap circuit 7 of FIG. 7. In both graphs the bandgap reference is swept over temperature at 10 different values of npn beta representing process variations.

For both families of curves the maximum beta variations is assumed to be 2 to 1. From the graph it can be noted that the family of curves for the conventional bandgap voltage reference spreads its values by more than 30 mV with the beta variations. The family of curves for the beta corrected bandgap voltage reference spreads its values by only a few mV with a slight dependence on temperature.

Furthermore it can be noted that the absolute value of the bandgap voltage reference for the beta corrected case is lower and closer to the theoretical value of silicon bandgap (1.21V). Also it can be observed that, while for traditional bandgap circuits the correlation between the temperature coefficient of the reference voltage and the room temperature value of the reference itself is positive, for the beta corrected bandgap this correlation is actually negative. This is inherently an important advantage because it reduces the total tolerance of the reference across process and temperature.

Although the present invention has been described above with particularity, this was merely to teach one of ordinary skill in the art how to make and use the invention. Many additional modifications will fall within the scope of the invention. Thus, the scope of the invention is defined by the claims which immediately follow.

What is claimed is:

1. A method for generating a substantially process insensitive reference voltage, comprising:

generating a current source of a known value that is substantially independent of the manufacturing process variations;

driving the base of a bipolar transistor with said current source; and biasing the emitter and collector of said transistor such that it remains in the forward active region, such that its base-emitter voltage will be a reference voltage determined primarily by the base current, will vary predictably with temperature and be substantially invariant with process.

2. The method of claim 1, wherein the resultant process insensitive reference voltage is additionally made substantially temperature insensitive, further comprising:

generating a PTAT voltage responsive to the difference between the base-emitter voltages of two structurally similar bipolar transistors operated at substantially different current densities; and summing said PTAT voltage reference with the base-emitter voltage of the transistor of claim 1, in proportion such that the positive temperature coefficient of the PTAT voltage and the negative temperature coefficient of said base-emitter voltage will be in comparable magnitude and will substantially cancel, giving a net reference voltage substantially independent of temperature and process.

3. A method for generating a substantially process insensitive reference voltage within an integrated circuit, comprising:

generating a current source responsive to the current gain of a first bipolar transistor within said integrated circuit; and driving a second bipolar transistor of similar structure within said integrated circuit, such that its collector current will be controlled to be substantially equal to said generated current source and will operate in the linear active region such that its base-emitter voltage will be determined primarily by said controlled collector current, establishing a reference voltage that will vary predictably with temperature and be substantially invariant with process.

4. The method of claim 3, wherein the resultant process insensitive reference voltage is additionally made substantially temperature insensitive, further comprising:

generating a PTAT voltage responsive to the difference between the base-emitter voltages of two structurally similar bipolar transistors within the integrated circuit, the two said transistors being operated at substantially different current densities; and summing said PTAT voltage with the process insensitive base-emitter voltage of said second transistor of claim 3, in proportion such that the positive temperature coefficient of the PTAT voltage and the negative temperature coefficient of the base-emitter voltage of said second transistor will be in comparable magnitude and will substantially cancel, resulting in a net reference voltage that is substantially independent of process and temperature.

5. A method for generating a substantially process independent reference voltage by compensating for the process-induced voltage dependence of the base-emitter forward voltage of a first bipolar transistor, comprising:

biasing said first bipolar transistor in the forward active region with a substantially process independent collector current;

generating a current source responsive to the current gain of a second bipolar transistor that is substantially similar in structure to said first transistor;

passing this current through a resistive element generating a compensating voltage that is responsive to the current gain of said second bipolar transistor; and summing said compensating voltage with the base-emitter voltage of said first bipolar transistor in such proportion and polarity that the voltage across the resistive element compensates for the process-dependent value of the base-emitter voltage of said first transistor, the net reference level becoming substantially independent of transistor current gain.

6. The method of claim 5, wherein said current source responsive to the current gain of said second transistor is made substantially proportional to current gain and the polarity of the summing of said compensating voltage to said base-emitter voltage is additive.

7. The method of claim 5, wherein the current source responsive to the current gain of said second transistor is made substantially inversely proportional to current gain and the polarity of the summing of said compensating voltage to said base-emitter voltage is subtractive.

8. The method of claim 5, wherein the reference voltage is further made temperature independent, further comprising:

generating a PTAT voltage responsive to the difference between the base-emitter voltages of two structurally similar bipolar transistors operated at substantially different current densities; and summing said PTAT voltage reference with said process insensitive reference level generated by the method of claim 5, in proportion such that the positive temperature coefficient of the PTAT voltage and the negative temperature coefficient of said reference level will be in comparable magnitude and will substantially cancel, resulting in a substantially process and temperature insensitive reference voltage.

* * * * *

UNITED STATES PATENT AND TRADEMARK OFFICE

CERTIFICATE OF CORRECTION

PATENT NO. : 7,071,673 B2
APPLICATION NO. : 10/911467
DATED : July 4, 2006
INVENTOR(S) : Paolo Menegoli and Carl K. Sawtell It is certified that error appears in the above-identified patent and that said Letters Patent is hereby corrected as shown below:

On The Title Page; Item (73) should read -- Acutechnology Semiconductor Inc. (San Jose, CA) --.

Signed and Sealed this

Twenty-fourth Day of July, 2007

JON W. DUDAS
*Director of the United States Patent and Trademark Office*